US005806754A

United States Patent [19]

Boyle

[11] Patent Number: 5,806,754

[45] Date of Patent: Sep. 15, 1998

[54] NEGATIVE AND PHOTO HOLDER

[75] Inventor: Daniel J. Boyle, Hartland, Wis.

[73] Assignee: Rock-Tenn Company, Norcross, Ga.

[21] Appl. No.: 859,756

[22] Filed: May 21, 1997

Related U.S. Application Data

[60] Provisional application No. 60/018,395, May 29, 1996.

[51] Int. Cl.[6] ..... B65D 5/18

[52] U.S. Cl. ..... 229/72; 206/455; 229/67.3; 493/121

[58] Field of Search ..... 206/232, 308.3, 206/449, 455, 456, 425; 229/67.1–67.4, 72; 493/121, 162

[56] References Cited

U.S. PATENT DOCUMENTS

| | | | |
|---|---|---|---|
| 508,394 | 11/1893 | Andrews | 206/425 |
| 510,350 | 12/1893 | Lochmann | 206/425 |
| 621,732 | 3/1899 | Wyman | 206/67.3 |
| 642,190 | 1/1900 | Wiley | 229/72 |
| 766,724 | 8/1904 | Noble | 206/425 |
| 983,964 | 2/1911 | White | 206/425 |
| 1,956,325 | 4/1934 | Hart | 229/67.3 |
| 2,729,258 | 1/1956 | Pentland et al. | 229/67.3 |
| 3,073,508 | 1/1963 | Hiersteiner | 229/67.3 |
| 5,398,866 | 3/1995 | Bluemle | 229/67.1 |
| 5,593,086 | 1/1997 | Ho | 229/67.4 |

*Primary Examiner*—Jimmy G. Foster
*Attorney, Agent, or Firm*—Schwegman, Lundberg, Woessner, and Kluth, P.A.

[57] ABSTRACT

A folder for holding objects therein having two independently expandable pockets. A bottom end adjoins front and back panels along their respective bottom edges. A divider panel is disposed within the folder between the front and back panels separating the folder into two pockets. Each pocket includes a pair of expandable side panels permitting expansion of each pocket independent of the other. The bottom end is expandable between the front and back panels equal to the total combined expansion of the expandable sides of the two pockets. An open bottom corner is disposed between the bottom end and the expandable sides on each edge of the folder. The open comers permit free expansion of the expandable sides without interference from the bottom end. The bottom edge of the divider panel extends downward less than the front and back panels so that it does not interfere with full expansion of the bottom end.

15 Claims, 4 Drawing Sheets

NEGATIVE AND PHOTO HOLDER

This is a non-provisional utility patent application claiming the benefit of the filing date of U.S. Ser. No. 60/018,395, filed May 29, 1996, entitled NEGATIVE AND PHOTO HOLDER.

FIELD OF THE INVENTION

The present invention relates to an apparatus for holding objects therein and more specifically to a one-piece folder having two independently expandable pockets for holding photo prints and negatives therein separately from one another.

BACKGROUND OF THE INVENTION

As with much of today's manufacturing technology, the method of producing photographic prints from a roll of film has become highly automated. Rolls of film are typically spliced together forming a continuous film strip. The strip is run through a photo processing machine which develops the negatives and produces one or more sets of prints. The machine also cuts the negatives and prints and stacks them for insertion into a print folder. Machines today, such as those produced by Gretag Imaging, Inc., of Chicopee, Mass., also are capable of automatically inserting the prints and negatives into the print folders. The machine includes a means such as a mechanism or shovel for opening the pockets and inserting the prints and negatives into the appropriate pockets. Many photo processors, however, still hand-insert prints and negatives into the folders.

Folders for holding photo prints currently are produced from a relatively flimsy or flexible paper material having a single print pocket. The print pockets are sometimes expandable along the side edges but not the bottom edge of the folder. Some folders also include an expandable bottom end as well. Additionally, some folders have an extra pocket in front of the print pocket for holding the photo print negatives. This type of paper folder has a floating divider which is simply glued into the folder forming two separate pockets. The negative and print pockets both may expand through movement of the divider but not independently from one another. The folder also usually includes glue panels along the sides for adhering the front and back panels of the folder together. The glue panels terminate within one of the pockets below its top edge.

Conventional paper folders perform adequately where a standard number of prints, such as 24 or 36 are inserted into the print pocket by machine or by hand. However, it is common today for customers to order double sets of prints amounting to as many as 80 prints being inserted into a single folder. Inserting such a large number of photo prints within the print pocket of a conventional paper folder is difficult whether by hand or by the processing machine. Either the bottom end does not expand to accommodate the thickness of the print stack or the bottom end, though expandable, bows because of the paper folder's flexibility. The prints tend to splay upward toward the top opening of the print pocket. Damage may occur to the edges of some of the prints. Also, the closure panel for the folder is difficult to close if some of the prints extend outward from within the pocket. Prints also tend to get caught or hung up on the glue panels when being inserted into the print pocket. This can cause the machine to damage either the folder, the prints, or both and cause the machine to malfunction and stop. This can also be annoying to the person inserting the prints by hand and again cause damage to the prints or the folder.

Placing negatives in the front pocket is also difficult. Since the pocket is generally not expandable independently of the print pocket, putting such a large number of negatives and prints in the pockets either by hand or machine tends to pull the glue panels from their attaching surfaces. The edges of the negatives also have a tendency to catch or hang up on the edges of the glue panels when being placed within the front pocket. A machine inserting the negatives may damage the folder or negatives or may malfunction if the negatives catch on the glue panels. A person inserting the negatives into the pocket must be careful to not catch the edge on the glue panels, which takes extra and unnecessary effort and can be annoying as well.

Another problem with conventional paper folders is that they do not provide a sturdy, long-term storage container for photographs and negatives. The paper is generally flexible and flimsy, which does not provide protection for the prints and negatives held within the folder. Conventional folders are especially susceptible to damage or failure when stuffed with as many as 80 prints and negatives. Additionally, the conventional paper material is not sturdy enough for a rigorous process of imprinting sophisticated promotional and advertising information on the folders which is necessary in today's competitive market.

What is needed is a print folder having separate independently expandable print and negative pockets. What is also needed is a print folder which is readily substituted for a conventional paper folder and compatible with existing automatic photo processing machines. What is further needed is a print folder where the glue panels are constructed so as to not catch an edge of objects being inserted within the pockets. What is still further needed is a print folder which is produced from a relatively sturdy material such as paperboard suitable for long-term storage of objects therein and printing of sophisticated promotional material thereon and is bio-degradable, recyclable and perhaps already recycled. What is also needed is a relatively inexpensive print folder produced from a single unitary blank of such material.

SUMMARY OF THE INVENTION

The negative and photo holder of the invention is constructed from a unitary blank of material and has two independently expandable pockets therein for receiving and holding negatives and photo prints.

The apparatus has a back panel and a front panel hingedly attached along their respective bottom edges by an expandable bottom end. A divider panel is hingedly attached to the folder along a side edge and is folded such that it is disposed between the front and back panels. The divider panel separates the folder into two separate pockets, a print pocket and a negative pocket.

Each pocket has expandable sides which permit the pocket to expand to a predetermined thickness. The print and negative pockets are expandable independently from one another along their respective side edges. The bottom end is expandable between the front and back panels. An open bottom corner between the bottom end and the expandable sides on each edge of the folder permits free expansion of either or both pockets without interference by the bottom end. The divider panel is also not connected along its bottom edge to the bottom end and does not extend down as far as the bottom edges of the front and back panels so it does not interfere with expansion of the bottom end.

Glue panels used to attach the various panels to one another in order to construct the folder are formed so as to not interfere with insertion of prints or negatives within the pockets. The folder is constructed to eliminate any glue panel within the negative pocket and to eliminate the glue panel edge typically found in conventional print folders. The glue panels extend upward to a height equal to the divider panel to which they attach. The tops of the glue panels and the divider panel also have the identical contour. This eliminates the glue panel edge inset from the top of the divider panel which would catch an edge of a print being inserted into the print pocket. Additionally, the glue panels and divider panel extend upward beyond the expandable side panels which also aids in inserting prints in the folder without hanging up on the vertical edges of the glue panels.

The print folder of the invention is compatible with existing automated photo processing machines such as those manufactured by Gretag Imaging, Inc. The print folder permits independent expansion of the print and negative pockets. The folder also enhances automatic or manual insertion of photo prints and negatives into their respective pockets by providing a sturdy folder with improved glue panel and panel configurations which prevent prints and negatives from getting caught or hung up on the edges of the panels.

DESCRIPTION OF THE PREFERRED EMBODIMENT

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
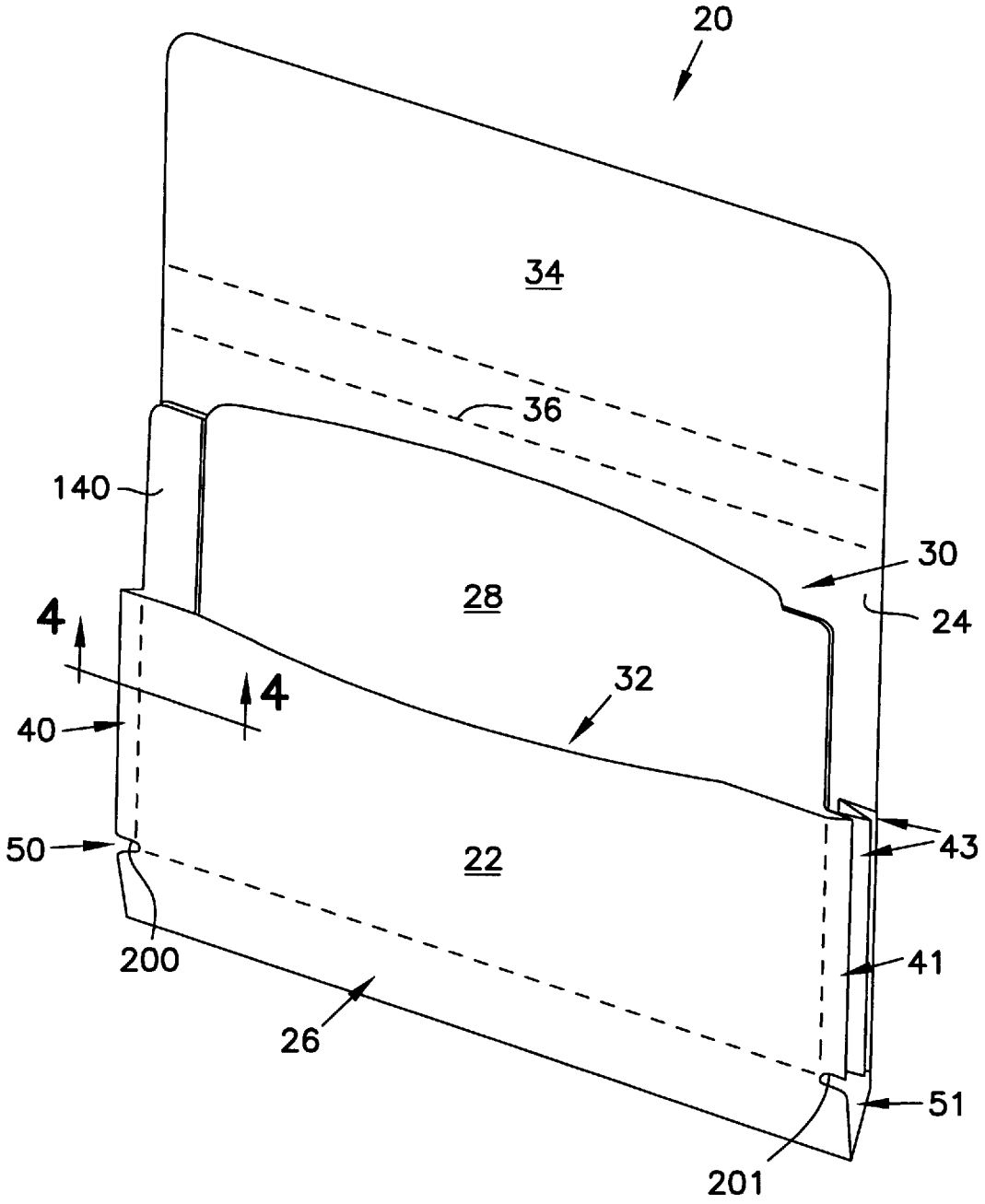
FIG. 1 is an elevational perspective view of a photo and negative holder constructed in accordance with the present invention.

Referring now in more detail to the drawings, FIG. 1 illustrates a folder 20 constructed in accordance with one embodiment of the present invention. Folder 20 has a front panel 22 and a back panel 24 generally parallel and hingedly connected to the front panel along an expandable bottom end 26. A divider panel 28 is disposed between front panel 22 and back panel 24 separating folder 20 into two-pockets, a print pocket 30 is disposed between back panel 24 and divider panel 28 and a negative pocket 32 is disposed between divider panel 28 and front panel 22.

A closure panel 34 is hingedly connected to back panel 24 along a score line 36. Closure panel 34 may be folded down overlapping front panel 22 to cover print pocket 30 and negative pocket 32 for protecting the photographs and negatives held in the pockets.

Front panel 22 is joined to divider panel 28 by a pair of expandable sides 40 and 41. Back panel 24 and divider panel 28 are joined by a pair of expandable sides 42 and 43. Open bottom corners 50 and 51 are disposed at the lower end of each of the adjacent sides 40, 42 and 41, 43, respectively, allowing bottom end 26 to expand along with the expandable sides of folder 20.

Folder 20 is intended to substitute for a conventional paper print folder. Folder 20 is also intended to be compatible with an existing automated photo processing machine which will become evident to those skilled in the art after reading the description of the invention.

Figure 2:
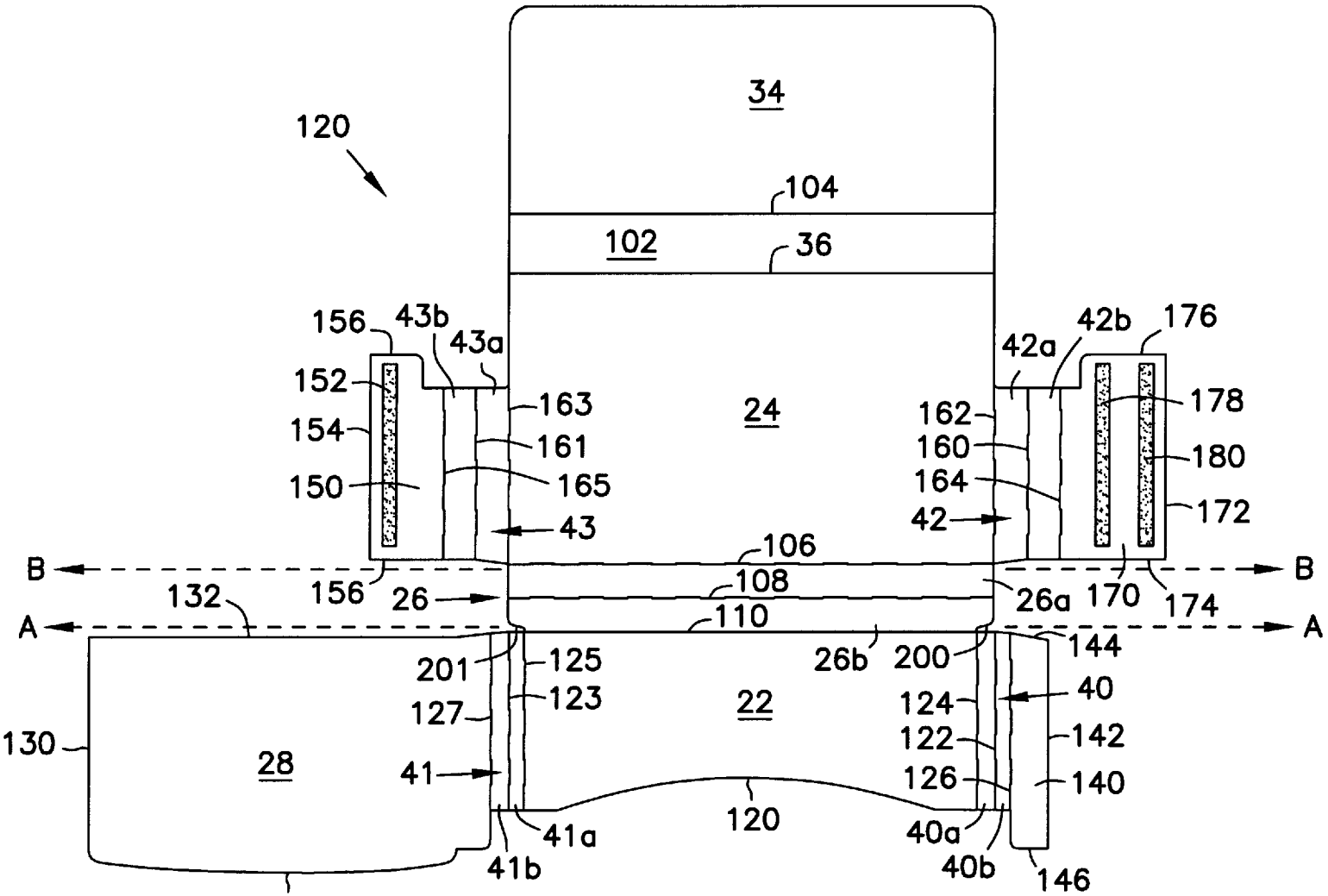
FIG. 2 is an elevational plan view of a material blank for forming the photo and negative holder of FIG. 1 constructed in accordance with the present invention.
Figure 3:
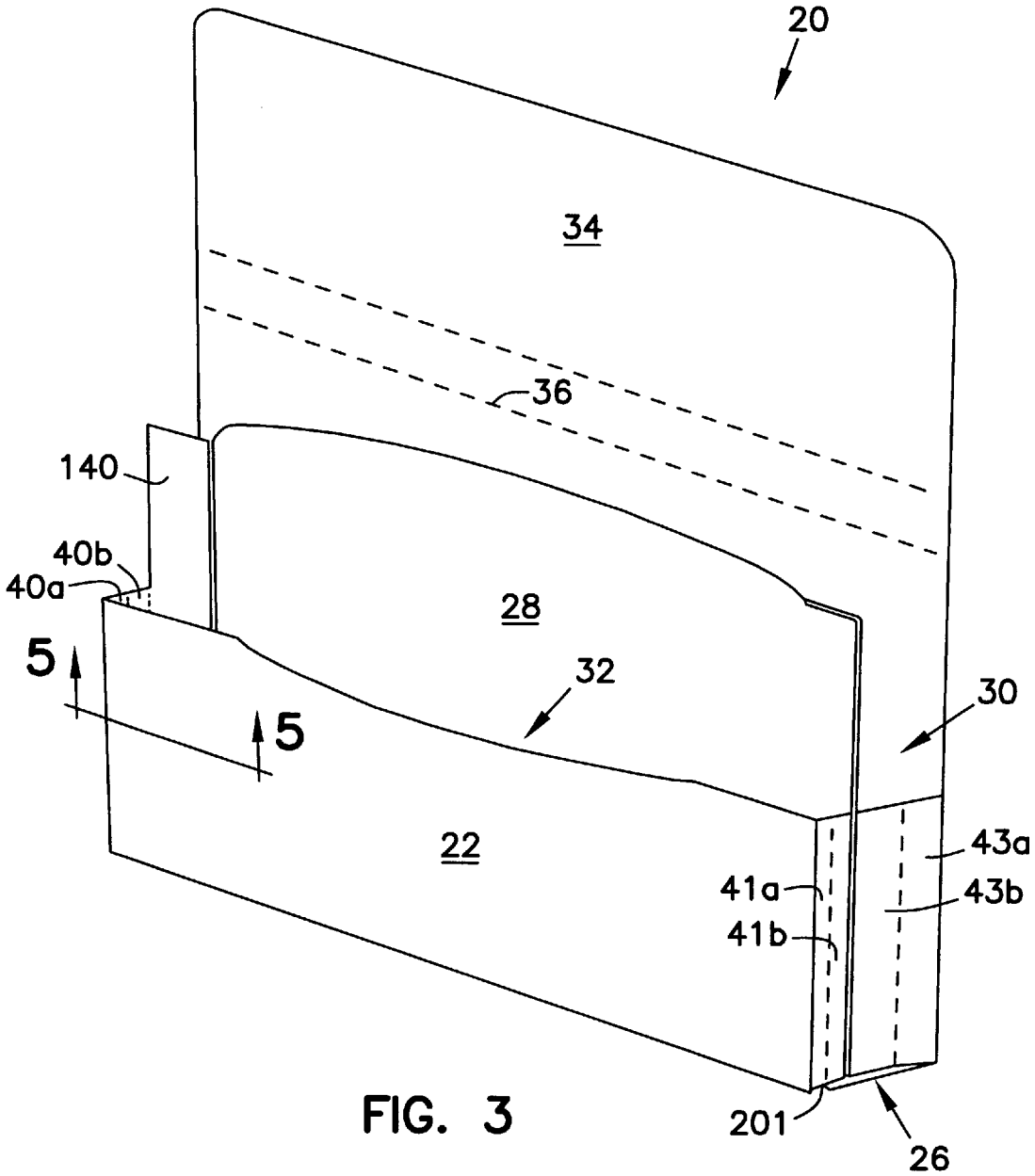
FIG. 3 is an elevational perspective view of the photo and negative holder of FIG. 1 showing both pockets in an expanded condition.

FIG. 2 illustrates a one-piece material blank 100 constructed in accordance with one embodiment of the present invention which is used to produce folder 20 of FIG. 1. Closure panel 34 of blank 100 is attached along a top edge of back panel 24 along score line 36. Closure panel 34 includes an expansion panel 102 defined between score line 36 and a fold line 104 formed in the closure panel spaced from and parallel to score line 36.

Bottom end 26 includes a central score line 108 dividing the bottom end into a first bottom panel 26*a* and a second bottom panel 26*b*. Bottom panels 26*a* and 26*b* in the present embodiment are of essentially the same size. As will be evident to those skilled in the art, the bottom panels may differ in size and shape from one another without departing from the scope of the invention. First bottom panel 26*a* is hingedly attached to the bottom edge of back panel 24 along a score line 106 which is parallel to and spaced from central score line 108. The bottom edge of front panel 22 is hingedly attached to second bottom panel 26*b* along a score line 110 which is parallel to and spaced from central score line 108.

Front panel 22 includes a top edge 120 which in the present embodiment curves from expandable sides 40 and 41 slightly downward toward bottom end 26. The curve of top edge 120 is merely added to accommodate presently utilized photo printing equipment during the automated process of filling the pockets of folder 20. As will be evident to those skilled in the art, front panel 22 including top edge 120 may take on any number of configurations without departing from the scope of the present invention.

Each of expandable sides 40 and 41 includes a central vertical score line 122 and 123, respectively, dividing side 40 into a first side panel 40*a* and a second side panel 40*b* and dividing side 41 into a first side panel 41*a* and a second side panel 41*b*. First side panels 40*a* and 41*a* are hingedly attached to the opposite side edges of front panel 22 along score lines 124 and 125, respectively. Score lines 124 and 125 are parallel to their respective central vertical score lines 122 and 123 in the present embodiment.

An attachment panel 140 is hingedly attached along a score line 126 which is parallel to and spaced from central score line 122 to second side panel 40*b*. Attachment panel 140 includes a free edge 142 opposite score line 126, a bottom edge 144 and a top edge 146 opposite the bottom edge. Bottom edge 144 is slightly tapered away from bottom end 26 relative to an imaginary line "A" defined by score line 110 of the bottom end. The distance between bottom edge 144 and line "A" is preferred to permit complete expansion of bottom end 26 as is described below.

Divider panel 28 is hingedly attached to second side panel 41*b* along a score line 127 which is parallel to and spaced from central score line 123. Divider panel 28 includes a free edge 130 disposed opposite and parallel to score line 127, a bottom edge 132 and a top edge 134 opposite the bottom edge. Bottom edge 132 in the present embodiment is parallel to score line 110 although the bottom edge could be curved toward its top edge 134 as will be evident to those skilled in the art. Bottom edge 132 is also preferably spaced from imaginary line "A" away from bottom end 26 for the same reason as bottom edge 144 of attachment panel 140.

Each of expandable sides 42 and 43 includes a central vertical score line 160 and 161, respectively, dividing side 42 into a first side panel 42*a* and a second side panel 42*b* and dividing side 43 into a first side panel 43*a* and a second side panel 43*b*. First side panels 42*a* and 43*a* are hingedly attached adjacent bottom end 26 to a portion of opposite side edges of back panel 22 along score lines 162 and 163, respectively. Score lines 162 and 163 are parallel to and spaced from their respective central vertical score lines 160 and 161 in the present embodiment.

Disposed along the same edge of blank 100 as divider panel 28 is a first glue panel 150 which includes on one side a strip of adhesive 152 of a type suitable to permanently join the glue panel to its appropriate mating panel as is described below. Glue panel 150 includes a free edge 154, a bottom edge 156, and a top edge 158 opposite the bottom edge. Glue panel 150 is hingedly attached to side panel 43*b* opposite free edge 154 along a score line 165 which is parallel to and spaced from central score line 161. Bottom edge 156 is preferably slightly offset away from bottom end 26 from an imaginary line "B" defined by score line 106. This offset is again for permitting complete expansion of bottom end 26 as is described below.

A second glue panel 170 is hingedly attached along a score line 164 to side panel 42*b* on the same side of blank 100 to which attachment panel 140 is connected. Second glue panel 170 includes a free edge 172 essentially parallel to and opposite score line 164, a bottom edge 174 spaced from imaginary line "B" away from bottom end 26, and a top edge 176 opposite the bottom edge. Second glue panel 170 includes a pair of adhesive strips 178 and 180 on one side for permanently attaching the glue panel to its mating panel as is described below. Adhesive strip 178 is disposed adjacent score line 164 and adhesive strip 180 is disposed adjacent free edge 172.

To construct folder 20 from blank 100, first glue panel 150 is folded along score line 163 of expandable side 43 such that it overlaps and confronts back panel 24 with adhesive strip 152 exposed and facing away from the back panel. Glue panel 150 is then folded along central score line 161 such that second side panel 43*b* overlaps and confronts first side panel 43*a*. Glue panel 150 is then folded along score line 165 to overlap and confront second side panel 43*b* again exposing adhesive strip 152.

Similarly, second glue panel 170 is folded along score line 162 of expandable side 42 to overlap and confront back panel 24 with adhesive strips 178 and 180 exposed and facing away from the back panel. Glue panel 170 is then folded along central score line 160 such that second side panel 42*b* overlaps and confronts first side panel 42*a*. Glue panel 170 is then folded along score line 164 to overlap and confront second side panel 42*b* again exposing adhesive strips 178 and 180.

Divider panel 28 is then folded along central fold line 123 of expandable side 41 so that it confronts and lies adjacent to front panel 22. Attachment panel 140 is similarly folded along central score line 122 of expandable side 40 so that it confronts and overlaps a portion of on the same side of front panel 22 as divider panel 28. As will be evident to those skilled in the art, divider panel 28, attachment panel 140, and both glue panels 150 and 170 must all be folded against the same side of blank 100 in order to properly construct folder 20 of the present embodiment.

The width of attachment panel 140 between its free edge 142 and score line 126 and the width of divider panel 28 between its free edge 130 and score line 127 are preferably such that when both panels are folded over onto front panel 22, free edge 130 of the divider panel and free edge 142 of the attachment panel are essentially parallel to and nearly abut against one another as is illustrated in FIGS. 1, 3, 4 and 5.

The portion of blank 100 including divider panel 28, front panel 22 and attachment panel 140 is then folded along central score line 108 of bottom end 26 such that the divider panel and attachment panel overlap and confront their respective glue panels 150 and 170. Adhesive strip 152 on first glue panel 150 is disposed such that it adheres to a portion of divider panel 28 adjacent score line 126. Adhesive strip 180 on second glue panel 170 will be the innermost of the two adhesive strips on the second glue panel when folded to confront back panel 22 and is disposed to adhere to divider panel 28 adjacent its free edge 130. Adhesive strip 178 being the outermost strip on glue panel 170 is disposed to adhere to attachment panel 140.

To close folder 20, closure panel 34 is folded along score line 36 to overlap front panel 22 of folder 20. To accommodate folder 20 when it is filled with negatives, photographs and the like, closure panel 34 may additionally be folded along fold line 104 such that expansion panel 102 is perpendicular relative to back panel 24 and closure panel 34. The width of expansion panel 102 between score line 36 and fold line 104 is determined by the desired fully expanded thickness of folder 20 defined between back panel 24 and front panel 22.

Further illustrated in FIG. 2 are a pair of notches 200 and 201, one formed on each side of blank 100 on opposite ends of bottom panel 26*b* adjacent expandable sides 40 and 41, respectively. Notches 200 and 201 are cut into bottom panel 26*b* far enough so that each side panel 40*a* and 41*a* is completely detached from the bottom panel. Each notch 200 and 201 permits its respective adjacent side panel 40*a* and 41*a* to rotate freely about their respective score lines 124 and 125 which is necessary for complete expansion of the expandable sides 40 and 41.

Additionally, it is necessary for the bottom edges 156 and 174 of glue panels 150 and 170, respectively, to be co-linear with or spaced from imaginary line "B" away from bottom end 26. This permits bottom end 26 to completely expand to a condition where bottom panels 26*a* and 26*b* are co-planar and parallel to one another. If the glue panels 150 and 170 or the expandable sides 42 and 43 extended beyond line "B" toward bottom end 26, they would interfere with the complete expansion of the bottom end.

Figure 4:
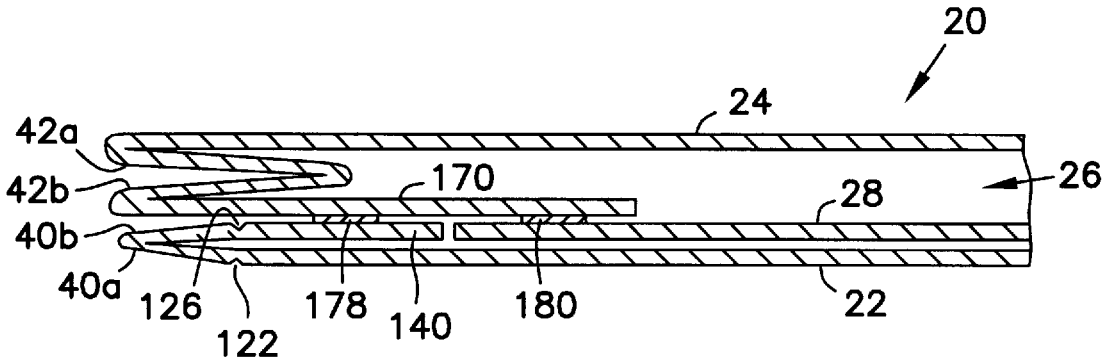
FIG. 4 is a cross-sectional view of a portion of the unexpanded folder taken along line 4—4 of FIG. 1, FIG. 5 a cross-sectional view of a portion of the expanded folder taken along line 5—5 of FIG. 3.
Figure 5:
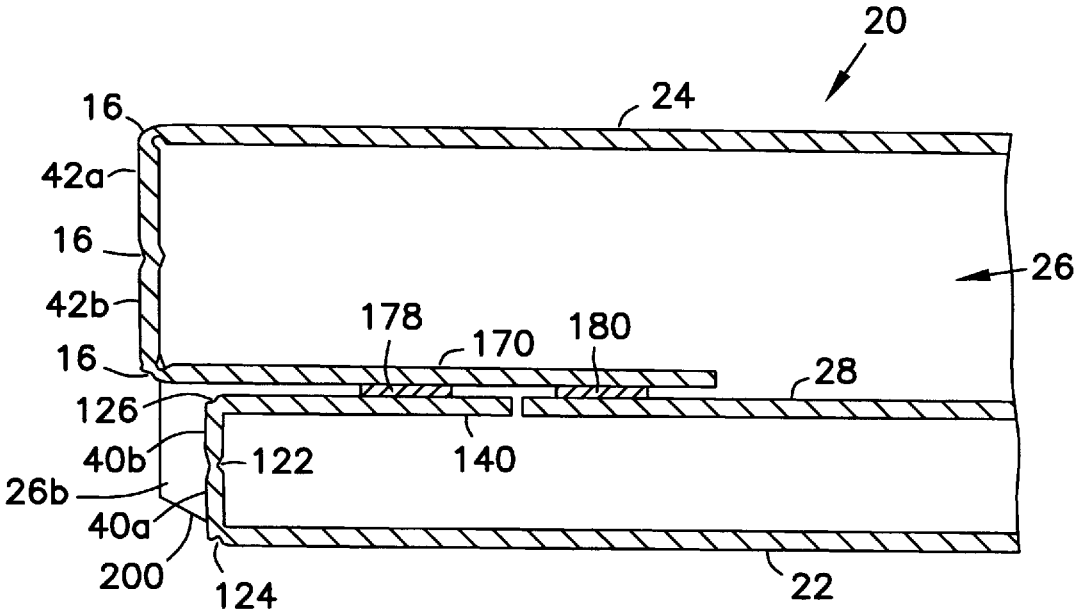

FIG. 4 illustrates a cross-section of one side of folder 20 in the unexpanded condition shown in FIG. 1. FIG. 5 illustrates a cross-section of one side of the folder in the fully expanded condition shown in FIG. 3. Expandable sides 40, 41, 42 and 43 in the unexpanded condition have their respective side panels folded over onto one another as illustrated in FIG. 4 for side panels 40*a* and 40*b* and for side panels 42*a* and 42*b*. As will be evident to those skilled in the art, expandable sides 41 and 43 function in the same manner as sides 40 and 42, respectively, as described below.

When a stack of prints is placed with pocket 30, side panels 42*a* and 42*b* pivot about score lines 162 and 164 and pivot away from one another about central score line 160. If pocket 30 is fully expanded, side panels 42*a* and 42*b* will be essentially co-planar and parallel as illustrated in FIG. 5. When a stack of negatives is placed within pocket 32, side panels 40*a* and 40*b* similarly pivot about score lines 124 and 126 and pivot away from one another about central score line 122. If pocket 32 is fully expanded, side panels 40*a* and 40*b* are essentially co-planar and parallel as illustrated in FIG. 5.

One important aspect of the present invention is that the top edges of the glue panels and attachment panel coincide with the outer top edges of the divider panel all coincide in height and contour. Top edge 146 of attachment panel 140 and a portion of top edge 134 of divider panel 28 align with top edge 176 of glue panel 170 when folder 20 is constructed. Similarly, top edge 156 of glue panel 150 aligns with a portion of top edge 134 of the divider panel when folder 20 is constructed. This prevents a corner of one or more prints being inserted into print pocket 30 from hanging up on an exposed edge of the glue panels. Another important aspect of the present invention is that the divider panel, attachment panel and glue panels extend upward higher than the expandable sides of the folder. This provides a guide or lead-in making insertion of prints and negatives into the pockets simpler and easier.

It is to be understood that the above description is intended to be illustrative, and not restrictive. Many other embodiments will be apparent to those of ordinary skill in the art upon reviewing the above description. The panels may be formed of many different configurations without departing from the scope of the invention. The folder may be utilized for holding objects other than photo prints and negatives as well. The scope of the invention should, therefore, be determined with reference to the claims, along with the full scope of equivalents to which such claims will be entitled.

What is claimed is:

1. A folder comprising:

a front panel having a plurality of connection edges and at least one free edge;

a pair of expandable sides, the front panel being disposed between the expandable sides;

expandable bottom end panels defined by a first edge and a second edge, said front panel being hingedly attached to the first edge of the expandable bottom end panels along at least one connection edge of the front panel;

a back panel having a first edge and a second edge, said back panel disposed between the expandable sides, said second edge of the back panel hingedly connected to the second edge of the expandable bottom end panels;

a divider panel disposed between the front panel and the back panel thereby forming a plurality of pockets in the folder, said divider panel connected with said expandable sides such that each pocket expands independently of each other;

a closure panel hingedly attached to said back panel along the first edge of the back panel, said closure panel folded over said free edge of the front panel; and wherein the front panel, expandable sides, expandable bottom end panels, back panel, divider panel, and closure panel are all fabricated from a unitary blank of material.

2. The folder as recited in claim 1, wherein said expandable bottom end panels extend from a first end to a second end, each end having a notch disposed therein to permit expansion of either or both pockets without interference by the bottom end panels.

3. The folder as recited in claim 1, wherein the divider panel is defined by a top edge and a bottom edge, wherein said bottom edge is tapered toward the top edge for facilitating expansion of said pockets.

4. A folder comprising:

a front panel disposed between two expandable sides, said front panel having a plurality of connection edges and at least one free edge;

each expandable side comprising a first side panel, a second side panel, and a glue panel, said glue panel defined by a top edge and a bottom edge;

at least one expandable side including an attachment panel, the attachment panel defined by a top edge and a bottom edge;

expandable bottom end panels defined by a first edge and a second edge, said front panel being hingedly attached to the first edge of the expandable bottom end panels along at least one connection edge of the front panel;

a back panel having a first edge and a second edge, said back panel disposed between the two expandable sides, said second edge of the back panel hingedly connected to the second edge of the expandable bottom end panels;

a divider panel disposed between the front panel and the back panel thereby forming a plurality of pockets therein, said divider panel connected with said expandable sides such that each pocket expands independently of each other;

a closure panel hingedly attached to said back panel along the first edge of the back panel, said closure panel folded over said free edge of the front panel;

wherein the divider panel is defined by a top edge and a bottom edge, and each top edge of the glue panels and the top edge of the attachment panel substantially coincide with the top edge of the divider panel.

5. The folder as recited in claim 4, wherein the expandable sides extend from proximate to the expandable bottom end panels to a free edge.

6. The folder as recited in claim 5, wherein the top edge of the divider panel is disposed further from the expandable bottom end panels than the free edge of the expandable sides.

7. The folder as recited in claim 5, wherein the top edge of each glue panel and the top edge of the attachment panel are disposed further from the expandable bottom end panels than the free edge of the expandable sides.

8. A one-piece material blank for forming a folder therefrom, the blank comprising:

a back panel having a first side edge and a second side edge;

a first set of side panels hingedly connected to the first side edge of the back panel to form a first expandable side;

a first glue panel hingedly attached to the first set of side panels;

a second set of side panels hingedly connected to the second side edge of the back panel to form a second expandable side;

a second glue panel hingedly attached to the second set of side panels;

a front panel disposed proximate to said back panel;

bottom end panels disposed between said front panel and said back panel, said bottom end panels hingedly attached to the front panel and the back panel;

a third set of side panels hingedly connected to a first side edge of the front panel to form a third expandable side;

a divider panel hingedly connected to the third set of side panels;

a fourth set of side panels hingedly connected to a second side edge of the front panel;

an attachment panel hingedly connected to said fourth set of side panels; and a closure panel hingedly connected to said back panel.

9. The blank for forming a folder as recited in claim 8, wherein the first and second glue panels each have adhesive material disposed thereon.

10. The blank for forming a folder as recited in claim 8, wherein the closure panel includes an expansion panel.

11. The blank for forming a folder as recited in claim 8, wherein the attachment panel is tapered away from the expandable bottom end panels.

12. The blank for forming a folder as recited in claim 8, wherein the divider panel is tapered away from the expandable bottom end panels.

13. The blank for forming a folder as recited in claim 8, wherein the first and second set of side panels are tapered away from the expandable bottom end panels.

14. The blank for forming a folder as recited in claim 8, wherein the bottom end panels extend from a first end proximate to the third set of side panels to a second end proximate to the fourth set of side panels, and the first and second ends each having a notch disposed therein.

15. A method for forming a folder, the method comprising the steps of:

providing a blank comprising;

a back panel having a first side edge and a second side edge;

a first set of side panels hingedly connected to the first side edge of the back panel, the first set of side panels having a first central score line disposed therein;

a first glue panel hingedly attached to the first set of side panels, the first glue panel having adhesive material disposed thereon;

a second set of side panels hingedly connected to the second side edge of the back panel, the second set of side panels having a second central score line disposed therein;

a second glue panel hingedly attached to the second set of side panels, the second glue panel having adhesive material disposed thereon;

a front panel disposed proximate to said back panel;

bottom end panels disposed between said front panel and said back panel, said bottom end panels hingedly attached to the front panel and the back panel, the bottom end panels having a central bottom panel score line disposed therein;

a third set of side panels hingedly connected to a first side edge of the front panel, the third set of side panels having a third central score line disposed therein;

a divider panel hingedly connected to the third set of side panels;

a fourth set of side panels hingedly connected to a second side edge of the front panel, the fourth set of side panels having a fourth central score line disposed therein;

an attachment panel hingedly connected to said fourth set of side panels; and a closure panel hingedly connected to said back panel;

folding the first set of side panels along the first central score such that the side panels overlap;

folding the first glue panel towards the back panel over the side panels such that the adhesive material is exposed and facing away from the back panel;

folding the second set of side panels along the second central score line such that the side panels overlap;

folding the second glue panel towards the back panel over the second set of side panels such that the adhesive material is exposed and facing away from the back panel;

folding the divider panel along the third central score line of the third set of side panels such that said divider panel adjacently confronts the front panel;

folding the attachment panel along the fourth central score line of the fourth set of side panels;

folding the front panel along the central bottom panel score line whereby the divider panel and attachment panel overlap and confront the first and second glue panels, respectively, and thereby adhering respective adhesive strips with respective mating panels; and folding the closure panel towards the front panel.

* * * * *